US009494156B2

(12) United States Patent
Maruyama et al.

(10) Patent No.: US 9,494,156 B2
(45) Date of Patent: Nov. 15, 2016

(54) PUMP

(75) Inventors: Koichi Maruyama, Miyazaki (JP); Junichi Aikawa, Miyazaki (JP); Naoto Yotsugi, Miyazaki (JP); Kotaro Iwagoshi, Kanagawa (JP)

(73) Assignee: ULVAC KIKO, INC., Miyazaki (JP)

( * ) Notice: Subject to any disclaimer, the term of this patent is extended or adjusted under 35 U.S.C. 154(b) by 394 days.

(21) Appl. No.: 13/522,911

(22) PCT Filed: Nov. 25, 2010

(86) PCT No.: PCT/JP2010/071042

§ 371 (c)(1),
(2), (4) Date: Jul. 18, 2012

(87) PCT Pub. No.: WO2011/092930

PCT Pub. Date: Aug. 4, 2011

(65) Prior Publication Data

US 2012/0294740 A1 Nov. 22, 2012

(30) Foreign Application Priority Data

Jan. 29, 2010 (JP) ..... 2010-019788

(51) Int. Cl.
*F04C 25/02* (2006.01)
*F04C 18/344* (2006.01)
(Continued)

(52) U.S. Cl.
CPC ..... *F04C 25/02* (2013.01); *F04C 18/3441* (2013.01); *F04C 28/06* (2013.01); *F04C 29/02* (2013.01); *F04C 28/24* (2013.01); *F04C 28/28* (2013.01); *F04C 29/12* (2013.01)

(58) Field of Classification Search
CPC .. F04B 49/225; F04B 37/14; F04B 39/0207; F04B 39/04; F04B 49/002; F04B 49/022; F04B 49/03; F04C 25/02; F04C 18/3441; F04C 28/06; F04C 29/02; F04C 29/025
USPC ..... 417/281, 295, 306; 418/88; 137/488, 137/489, 489.3, 489.5, 565.23
See application file for complete search history.

(56) References Cited

U.S. PATENT DOCUMENTS 3,406,897 A * 10/1968 Diels ..... 417/295
4,173,440 A * 11/1979 Libis ..... 418/84
(Continued)

FOREIGN PATENT DOCUMENTS

JP 51-83209 A 7/1976
JP 6-200889 A 7/1994
JP 10-339288 A 12/1998

*Primary Examiner* — Alexander Comley
(74) *Attorney, Agent, or Firm* — Arent Fox LLP

(57) ABSTRACT

A pump that includes a pump body 10 which sucks in air from an inlet 7 and discharges the air; a hydraulic pump which pressure-feeds a lubricating oil to the pump body 10 in accordance with the driving of the pump body 10; a non-return valve 70 which is disposed in a valve accommodation portion 6 between the inlet 7 and the pump body 10 to open and close the valve accommodation portion 6; an air introduction path 19 which introduces air into a cylinder 74 of the non-return valve 70; and an air introduction valve 60 which opens the air introduction path 19 when the hydraulic pump is not operating. When the pump body 10 is stopped, the non-return valve 70 closes the inlet 7 in response to a difference in pressure between the pressure of the valve accommodation portion 6 reduced to a value equal to or less than atmospheric pressure by the operation of the pump body 10, and the pressure of the air introduced into the cylinder 74 by the opening of the air introduction valve 60 owing to the stoppage of the hydraulic pump associated with the stoppage of the pump body 10.

1 Claim, 5 Drawing Sheets

(51) Int. Cl.

| | |
|---|---|
| ***F04C 28/06*** | (2006.01) |
| ***F04C 29/02*** | (2006.01) |
| *F04C 28/24* | (2006.01) |
| *F04C 28/28* | (2006.01) |
| *F04C 29/12* | (2006.01) |

(56) References Cited

U.S. PATENT DOCUMENTS 4,193,742 A * 3/1980 Fischer ..... F04C 28/24 417/24
4,276,005 A * 6/1981 Bassan ..... 418/13
4,366,834 A * 1/1983 Hanson et al. ..... 137/489.3
4,483,667 A * 11/1984 Berges et al. ..... 418/84
4,525,129 A * 6/1985 Berges et al. ..... 418/84
4,844,702 A * 7/1989 Ceccherini et al. ..... 417/281
4,968,221 A * 11/1990 Noll ..... 417/295
4,995,797 A * 2/1991 Tsuboi ..... 418/84
5,018,947 A * 5/1991 Tsuboi ..... 417/295
5,236,313 A * 8/1993 Kim ..... 417/281
5,419,689 A * 5/1995 Holbrook ..... 417/507
7,854,601 B2 * 12/2010 Wagner ..... 418/13
2005/0260082 A1 * 11/2005 Conrad et al. ..... 417/410.3

* cited by examiner

PUMP

CROSS-REFERENCE TO RELATED APPLICATION

This Application is a National Stage entry of International Application No. PCT/JP2010/071042 having an international filling date of Nov. 25, 2010; which claims priority to Japanese Application No.: 2010-019788, filed Jan. 29, 2010; the disclosure of each of which is hereby incorporated in its entirety by reference.

TECHNICAL FIELD

This invention relates to a pump incorporating a hydraulic pump for supplying a lubricating oil.

BACKGROUND ART

To bring a vessel or the like, which is an object to be vacuumized, into a vacuum state, an oil-sealed rotary vacuum pump is directly connected to the vessel or the like. By so doing, an ideal exhaust system is formed, and the vacuum state can be achieved most easily and inexpensively. In this case, however, if the oil-sealed rotary vacuum pump is stopped, with the vacuum vessel being maintained in a vacuum, the oil-sealed rotary vacuum pump is also in a vacuum state. Thus, the lubricating oil of the oil-sealed rotary vacuum pump flows into a rotor chamber of the pump. When the rotor chamber is filled with the oil, the oil is pushed up from a pump inlet toward the upstream side.

If backflow of the oil occurs, as mentioned above, such drawbacks as the following occur: Vacuum piping and the vacuum vessel are contaminated and, in subsequent vacuum evacuation, the atmosphere of the vacuum vessel is contaminated with hydrocarbons from a vapor of the oil. As a result, ultimate pressure is increased, and carbon is deposited on the object to be vacuumized.

To avoid such drawbacks, an exhaust system as shown in FIG. 1 is generally used. That is, before an oil-sealed rotary vacuum pump 100 is stopped, a shut-off valve (V1) is closed to isolate and block a vacuum vessel 101 and the oil-sealed rotary vacuum pump 100 from each other. Then, an air introduction valve (V2) is opened to restore a rotor chamber of the oil-sealed rotary vacuum pump 100 to atmospheric pressure, whereafter the oil-sealed rotary vacuum pump 100 is stopped. Each time the oil-sealed rotary vacuum pump 100 is to be stopped, the air introduction valve (V2) is opened to return the rotor chamber of the oil-sealed rotary vacuum pump 100 to atmospheric pressure, thereby preventing backflow of a lubricating oil.

To prevent the oil from flowing backward to the upstream side, a pump is available which has a shut-off valve provided in a region ranging from an inlet for air to a rotor chamber of the pump (see, for example, Patent Document 1).

With such a pump, a pump body is driven to introduce air from an inlet and discharge air from an outlet. A hydraulic pump which is interlocked with the pump body is also provided, and a lubricating oil is supplied by the hydraulic pump to the pump body. A shut-off valve which opens and closes the inlet is disposed in a flow path from the inlet to the pump body. The shut-off valve is adapted to be urged in a direction in which it closes the inlet, and to open the inlet under the pressure of the lubricating oil pressure-fed by the hydraulic pump.

With the pump of the above configuration, when the pump body is operated, the hydraulic pump is also actuated. Upon this actuation, the shut-off valve is brought to an open state under the pressure of the lubricating oil. Air is introduced into the pump body from the inlet, whereby the vacuum vessel can be vacuumized. When the pump body is stopped, the hydraulic pump is also stopped, so that the pressure of the lubricating oil lowers. Thus, the shut-off valve closes the inlet under its urging force, and can prevent backflow of the lubricating oil.

PRIOR ART DOCUMENTS

Patent Documents

[Patent Document 1] JP-A-6-200889

SUMMARY OF THE INVENTION

Problems to be Solved by the Invention

In the configuration shown in FIG. 1, however, a control system which controls the oil-sealed rotary vacuum pump 100, the shut-off valve V1, and the air introduction valve V2 is operated under vacuum. Thus, mounting costs are involved, and there is need to ensure a considerable space for installing the shut-off valve V1 and the air introduction valve V2.

With the pump according to Patent Document 1, in a state where the operation of the pump body is stopped and the shut-off valve closes the inlet, the flow path from the inlet to the pump body is kept in a vacuum. During stoppage of the operation of the pump body, atmospheric pressure is exerted on the lubricating oil. Thus, the problem arises that the lubricating oil pressed by the atmospheric pressure flows backward into the flow path maintained in a vacuum, contaminating the flow path and the surroundings of the shut-off valve and the inlet. Particularly if airtightness is not held because of a defect in the surface where the shut-off valve and the inlet contact each other, for example, because of rusting, fatigue fracture of the member, or intervention of foreign matter, the problem occurs that the lubricating oil flows backward up to the vacuum vessel through the defective clearance.

The present invention has been accomplished in the light of the above-mentioned circumstances. It is an object of the present invention to provide a pump which can reliably prevent a lubricating oil from flowing into the upstream side and which is in a simple configuration.

Means for Solving the Problems

A first aspect of the present invention for attaining the above object lies in a pump comprising a pump body which sucks in air from an inlet and discharges the air to an outlet; a hydraulic pump which pressure-feeds a lubricating oil to the pump body in accordance with the driving of the pump body; a non-return valve which is disposed in a flow path between the inlet and the pump body to open and close the inlet; an air introduction path which introduces a gas having a higher pressure than a vacuum into the non-return valve; and an air introduction valve which closes the air introduction path under the pressure of the lubricating oil pressure-fed by the hydraulic pump when the hydraulic pump is operating, but opens the air introduction path when the hydraulic pump is not operating, wherein when the pump body is stopped, the non-return valve closes the inlet in response to a difference in pressure between the pressure within the flow path reduced to a value equal to or less than atmospheric pressure by the operation of the pump body, and the pressure of air introduced by the opening of the air introduction valve owing to the stoppage of the hydraulic pump associated with the stoppage of the pump body.

According to the above first aspect, when the pump body and the hydraulic pump are stopped, the air introduction valve opens the air introduction path to introduce air into the non-return valve. The pressure of this air is higher than the pressure of the flow path which has been reduced in pressure or vacuumized by the operation of the pump body. Thus, a pressure difference occurs between the pressure of the flow path and the pressure of air introduced into the non-return valve, so that the non-return valve closes the inlet. In this manner, the stoppage of the pump body results in the sealing of the flow path with the non-return valve. Consequently, the lubricating oil can be reliably prevented from flowing backward to the upstream side.

According to the pump concerned with the present aspect, the non-return valve and the air introduction valve for performing its opening and closing are all provided in the pump. Thus, a control system acting under a vacuum need not be provided between a vacuum vessel and the pump, so that space saving can be achieved. Moreover, the hydraulic pump is interlocked with the pump body, and the air introduction valve is opened and closed in association with this hydraulic pump, whereby the opening and closing of the non-return valve are achieved. Compared with the provision of a complicated and electrical control system as in the prior art, therefore, opening and closing control over the non-return valve can be realized easily. Hence, the costs involved in the development and production of the apparatus (exhaust system) can be cut down.

A second aspect of the present invention lies in the pump according to the first aspect, wherein when the non-return valve closes the inlet, the air introduction valve opens, whereby the air introduced into the non-return valve is introduced into the flow path.

According to such a second aspect, when the operation of the pump body is stopped, the inlet is closed with the non-return valve. At this time, the flow path ranging from the non-return valve to the pump body is subjected to vacuum break by air from the air introduction path. Thus, the lubricating oil pressed by atmospheric pressure can be prevented from contaminating the flow path and the surroundings of the non-return valve and the inlet.

A third aspect of the present invention lies in the pump according to the second aspect, wherein the non-return valve is equipped with a valve support where a cylinder is provided, and a valve body accommodated in the cylinder for opening and closing the inlet; the air introduction path is adapted to introduce the air into the cylinder; when the pump body is stopped, the valve body protrudes from the cylinder and closes the inlet in response to the difference in pressure between the pressure within the flow path reduced to the value equal to or less than atmospheric pressure by the operation of the pump body, and the pressure of the air introduced into the cylinder by the opening of the air introduction valve owing to the stoppage of the hydraulic pump associated with the stoppage of the pump body; and the valve support is provided with a communicating path for bringing the cylinder and the flow path into communication.

According to such a third aspect, the sealing of the inlet when the operation of the pump is stopped can be achieved by the non-return valve of a simple structure.

Effects of the Invention

According to the present invention, the lubricating oil can be reliably prevented from flowing into the upstream side, and the apparatus (exhaust system) of a simple configuration can be designed.

MODE FOR CARRYING OUT THE INVENTION

The embodiment of the present invention will now be described in detail based on the accompanying drawings.

Figure 1:
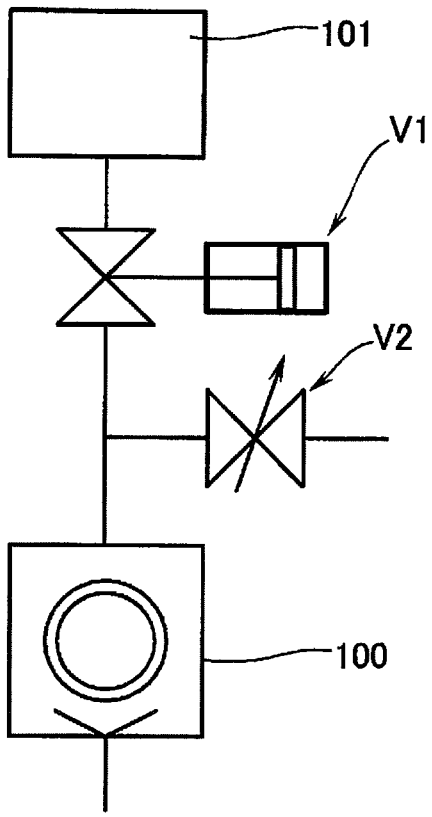
FIG. 1 is a view schematically illustrating the basic configuration of a pump according to prior art.
Figure 2:
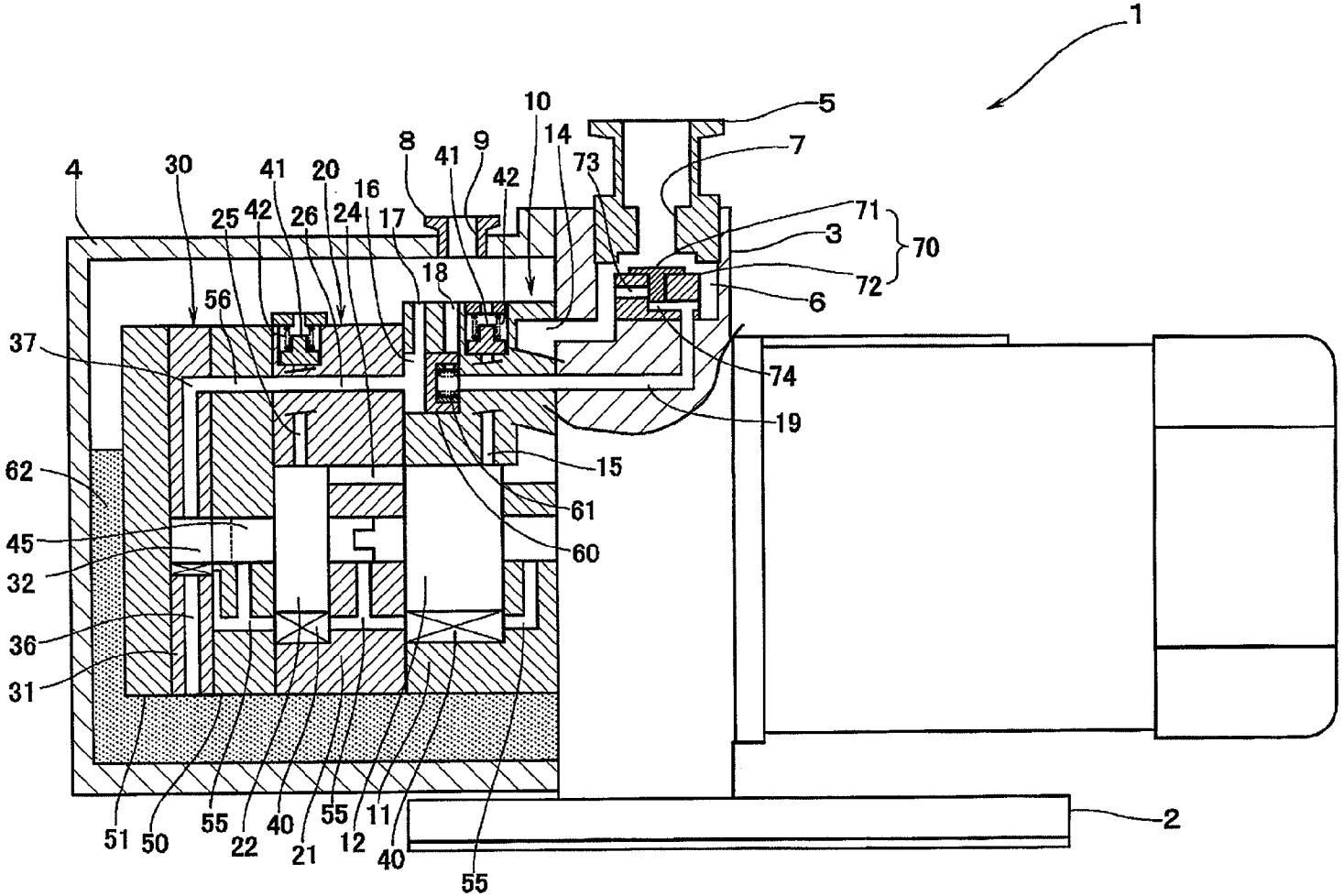
FIG. 2 is a development view of essential parts of a pump according to an embodiment of the present invention.
Figure 3:
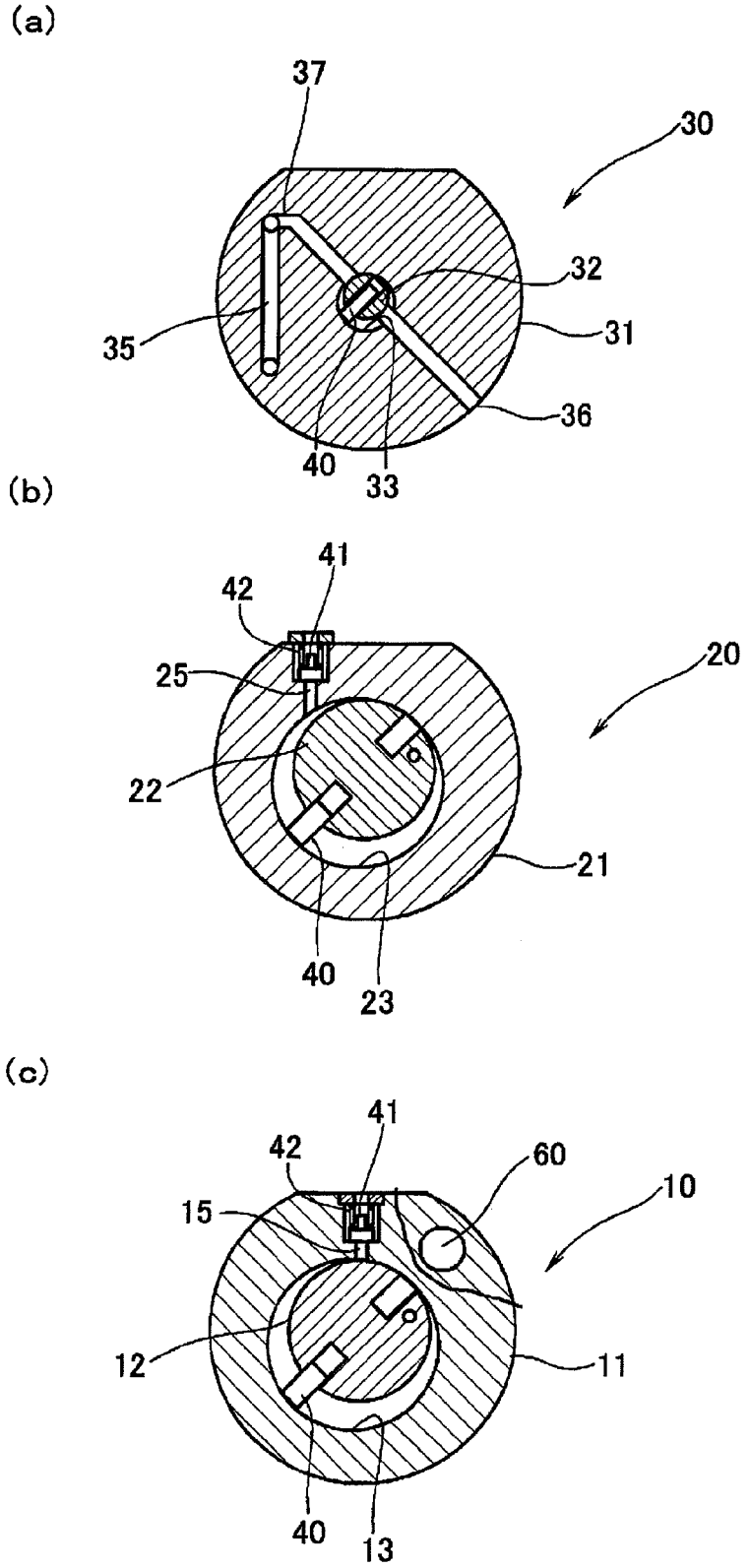
FIGS. 3(*a*) to 3(*c*) are sectional views of a hydraulic pump and a pump body constituting the pump.

The configuration of the pump according to the embodiment of the present invention will be described based on FIG. 2 and FIGS. 3(*a*) to 3(*c*). As shown in these drawings, a pump 1 is equipped with a flow path member 3 provided on a base block 2, and a case 4 is provided for the flow path member 3. The flow path member 3 is provided with a suction portion 5 to which an instrument or the like to be reduced in pressure or vacuumized is connected, and a valve accommodation portion 6 accommodating a non-return valve 70 (details will be described later) is provided. An inlet 7 serving as a flow path for air is formed in the suction portion 5, and the inlet 7 and the valve accommodation portion 6 communicate with each other. The case 4 is provided with a discharge portion 8 through which air sucked in from the suction portion 5 is discharged, and the discharge portion 8 is provided with an outlet 9 which allows communication between the interior and the exterior of the case 4 to serve as a flow path for air.

A first pump body 10 and a second pump body 20 are disposed inside the case 4. The first pump body 10 is equipped with a first casing 11 where a first pump chamber 13 is provided, and a first rotor 12 disposed eccentrically within the first pump chamber 13. Vanes 40 are mounted on the first rotor 12 so as to slide over the inner periphery of the first pump chamber 13, and the first pump chamber 13 is partitioned by the vanes 40 into a plurality of spaces.

Similarly, the second pump body 20 is equipped with a second casing 21 where a second pump chamber 23 is provided, and a second rotor 22 disposed eccentrically within the second pump chamber 23. Vanes 40 are mounted on the second rotor 22 so as to slide over the inner periphery of the second pump chamber 23, and the second pump chamber 23 is partitioned by the vanes 40 into a plurality of spaces.

The first casing 11 and the second casing 21 are fixed within the case 4, while the first rotor 12 and the second rotor 22 are rotatably supported by a common shaft 45 so as to rotate within the first pump chamber 13 and the second pump chamber 23.

The first casing 11 is provided with a first gas introduction path 14 which communicates with the first pump chamber 13 and the valve accommodation portion 6, and is also provided with a first gas discharge path 15 which communicates with the first pump chamber 13 and the interior of the case 4. The second casing 21 is provided with a second gas introduction path 24 which brings the first pump chamber 13 and the second pump chamber 23 into communication, and is also provided with a second gas discharge path 25 which communicates with the second pump chamber 23 and the interior of the case 4.

The first gas discharge path 15 and the second gas discharge path 25 are each provided with a delivery valve 41. The respective delivery valves 41 close the first and second gas discharge paths 15, 25 by springs 42 urged toward the first and second pump chambers 13, 23, and open when the pressures of the gases compressed by the first and second pump chambers 13 and 23 exceed predetermined values.

In the flow path member 3, the first pump body 10, and the second pump body 20, a gas flow path is formed which is composed of the inlet 7, the valve accommodation portion 6, the first gas introduction path 14, the second gas introduction path 24, the first gas discharge path 15, the second gas discharge path 25, the interior of the case 4, and the outlet 9. According to this configuration, the first rotor 12 and the second rotor 22 are driven to introduce a gas from the inlet 7, and the gas is introduced into the first pump chamber 13 via the valve accommodation portion 6 and the first gas introduction path 14. A part of the gas is compressed by the rotation of the first rotor 12, and discharged to the outside from the outlet 9 via the first gas discharge path 15 and the interior of the case 4. The remainder of the gas is passed through the second gas introduction path 24, introduced into the second pump chamber 23, and compressed by the rotation of the second rotor 22. Then, it is discharged to the outside from the outlet 9 via the second gas discharge path 25 and the interior of the case 4.

Within the case 4, a hydraulic pump 30 is disposed. The hydraulic pump 30 has a third casing 31 where a third pump chamber 33 is provided, and a third rotor 32 disposed eccentrically within the third pump chamber 33. Vanes 40 are mounted on the third rotor 32 so as to slide over the inner periphery of the third pump chamber 33, and the third pump chamber 33 is partitioned by the vanes 40 into a plurality of spaces.

The third casing 31 is mounted on the second pump body 20 via a mounting member 50, and is fixed by a pressing member 51. The third rotor 32 is mounted on the common shaft 45, and is adapted to act in association with the first rotor 12 and the second rotor 22.

A lubricating oil introduction path 36 for providing communication between the third pump chamber 33 and the outside is formed in the third casing 31. The lubricating oil introduction path 36 opens to a lower part of the case 4, and a lubricating oil 62 stored in the lower part of the case 4 is sucked into the third pump chamber 33 via the lubricating oil introduction path 36 by the rotation of the third rotor 32. The lubricating oil 62 sucked into the third pump chamber 33 and pressurized there is pressure-fed to lubricating oil flow paths 55, which have been formed in the third casing 31, the mounting member 50, the second casing 21 and the first casing 11 to serves as flow paths for the lubricating oil 62. Then, the lubricating oil 62 is supplied to the common shaft 45 and the first and second pump chambers 13, 23.

The first pump body 10 and the second pump body 20 are driven, whereby the hydraulic pump 30 is also operated in an interlocking manner. By this operation of the hydraulic pump 30, the lubricating oil 62 is supplied to the first pump chamber 13, the second pump chamber 23 and the common shaft 45. Thus, the first and second pump bodies 10 and 20 act smoothly to provide the capacity of the pump 1 stably.

The opening and closing of the non-return valve 70 will be described based on FIGS. 4 and 5.

The non-return valve 70 is disposed in the valve accommodation portion 6 (the flow path between the inlet 7 and the first pump body 10) of the flow path member 3. The non-return valve 70 is composed of a valve body 71 and a valve support 72. A cylinder 74 is provided in the valve support 72, and a piston portion 75 is provided in the valve body 71. The valve body 71 is formed so as to be capable of closing the opening of the inlet 7, and the piston portion 75 is disposed slidably within the cylinder 74. Because of such a configuration, the valve body 71 can protrude from the valve support 72 to close the inlet 7, and can separate from the inlet 7 to open the inlet 7.

A communicating flow path 76 communicating with the cylinder 74 to serve as a flow path for air is formed in the valve support 72, and the communicating flow path 76 communicates with an air introduction path 19 and the exterior of the valve support 72. A vacuum breaking flow path 73 which brings the cylinder 74 and the outside into communication is formed in the valve support 72. The vacuum breaking flow path 73 whose details will be described later is formed in the following configuration: When the valve body 71 does not seal the inlet 7, the valve body 71 closes the opening of the vacuum breaking flow path 73. When the valve body 71 protrudes from the cylinder 74 to close the inlet 7, on the other hand, the opening of the vacuum breaking flow path 73 is opened.

An introduction valve accommodation portion 16 of a cylindrical shape is provided in the first casing 11, and a lubricating oil discharge port 17 and an air introduction port 18 which communicate with the interior of the case 4 are provided in the introduction valve accommodation portion 16. Moreover, the introduction valve accommodation portion 16 communicates with the third pump chamber 33 via an introduction valve lubricating oil flow path 37 (see FIG. 2) provided in the third casing 31, a lubricating oil flow path 56 (see FIG. 2) provided in the mounting member 50, and a lubricating oil flow path 26 provided in the second casing 21. Thus, the lubricating oil is pressure-fed from the third pump chamber 33.

The air introduction path 19 through which air from the air introduction port 18 is introduced is provided in the flow path member 3 and the first casing 11. The air introduction port 18 is in communication with the cylinder 74 of the valve support 72 via the introduction valve accommodation portion 16 and the air introduction path 19.

An air introduction valve 60 is slidably disposed in the introduction valve accommodation portion 16. The air introduction valve 60 is a valve for opening and closing the air introduction path 19. Concretely, the air introduction valve 60, when located at its first position, closes the air introduction port 18 by use of its side surface (see FIG. 4) and, when it is located at its second position, its side surfaces opens the air introduction port 18 (see FIG. 5). Furthermore, the air introduction valve 60 is urged by a spring 61 so as to be located at the second position. This urging force of the spring 61 is adjusted such that the air introduction valve 60 is brought to the first position under the pressure of the lubricating oil pressure-fed from the lubricating oil flow path 26.

Figure 4:
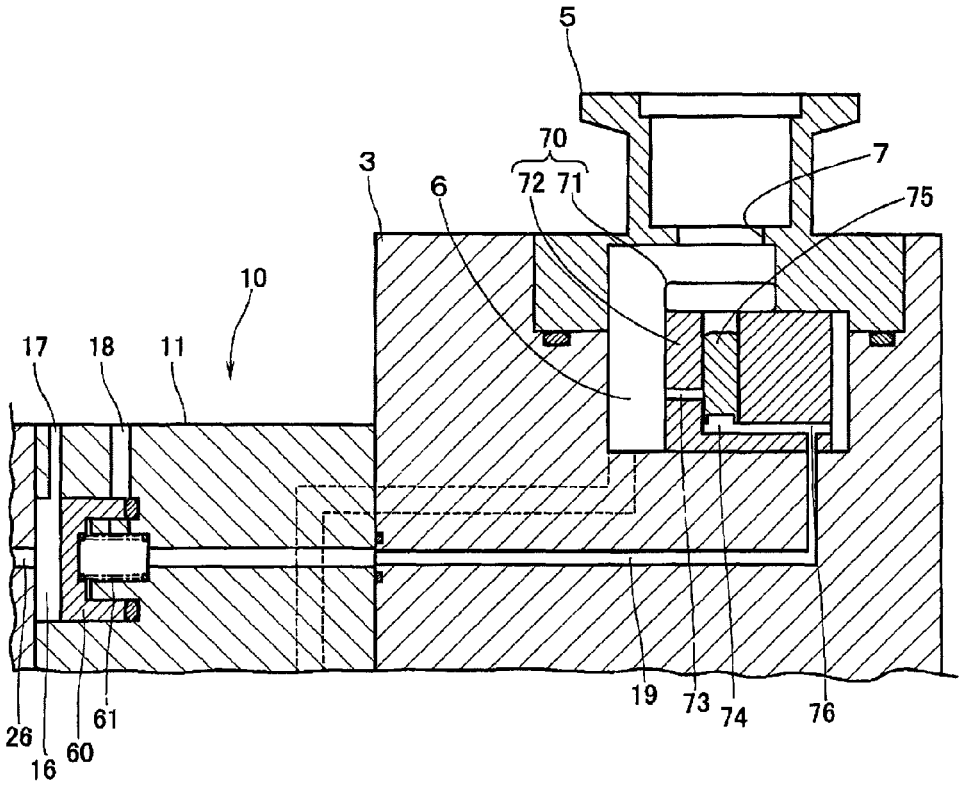
FIG. 4 is a sectional view of the essential parts illustrating the actions of the pump according to the embodiment.

As shown in FIG. 4, when the air introduction valve 60 is located at the first position, the air introduction port 18 and the air introduction path 19 are divided from each other by the air introduction valve 60, and the lubricating oil flow path 26 and the lubricating oil discharge port 17 are in communication. As shown in FIG. 5, when the air introduction valve 60 is at the second position, on the other hand, the air introduction port 18 and the air introduction path 19 are in communication, while the lubricating oil flow path 26 and the lubricating oil discharge port 17 are divided from each other by the air introduction valve 60.

When the pump 1 is operating, the so configured non-return valve 70 renders the inlet 7 open, as shown in FIG. 4. This will be described in detail. Before the operation of the pump 1, none of the first pump body 10, the second pump body 20 and the hydraulic pump 30 are working. Thus, the introduction valve accommodation portion 16 is not pressure-fed with the lubricating oil by the hydraulic pump 30, and the air introduction valve 60 lies at the second position.

When the first and second pumps 10 and 20 are operated, the valve accommodation portion 6 is made to fall into a vacuum state (brought to atmospheric pressure or lower). The interior of the cylinder 74 is also vacuumized, since it communicates with the valve accommodation port ion 6 via the communicating flowpath 76. At this time, the lubricating oil is pressure-fed to the introduction valve accommodation portion 16 by the hydraulic pump 30 interlocked with the first and second pumps 10, 20. If the pressure of this lubricating oil surpasses the urging force of the spring 61, the air introduction valve 60 moves to the first position. As a result, the valve accommodation portion 6, the cylinder 74 and the air introduction path 19 are cut off from the air introduction port 18 (the air) to become a sealed space. Thus, the valve accommodation portion 6 and the interior of the cylinder 74 have such pressures that they are both vacuumized by the first and second pumps 10 and 20. That is, no pressure difference occurs between the valve accommodation portion 6 and the interior of the cylinder 74. Hence, the valve body 71 does not protrude from the cylinder 74, and does not seal the inlet 7. The lubricating oil pressure-fed to the introduction valve accommodation portion 16 is discharged to the interior of the case 4 through the lubricating oil discharge port 17.

Figure 5:
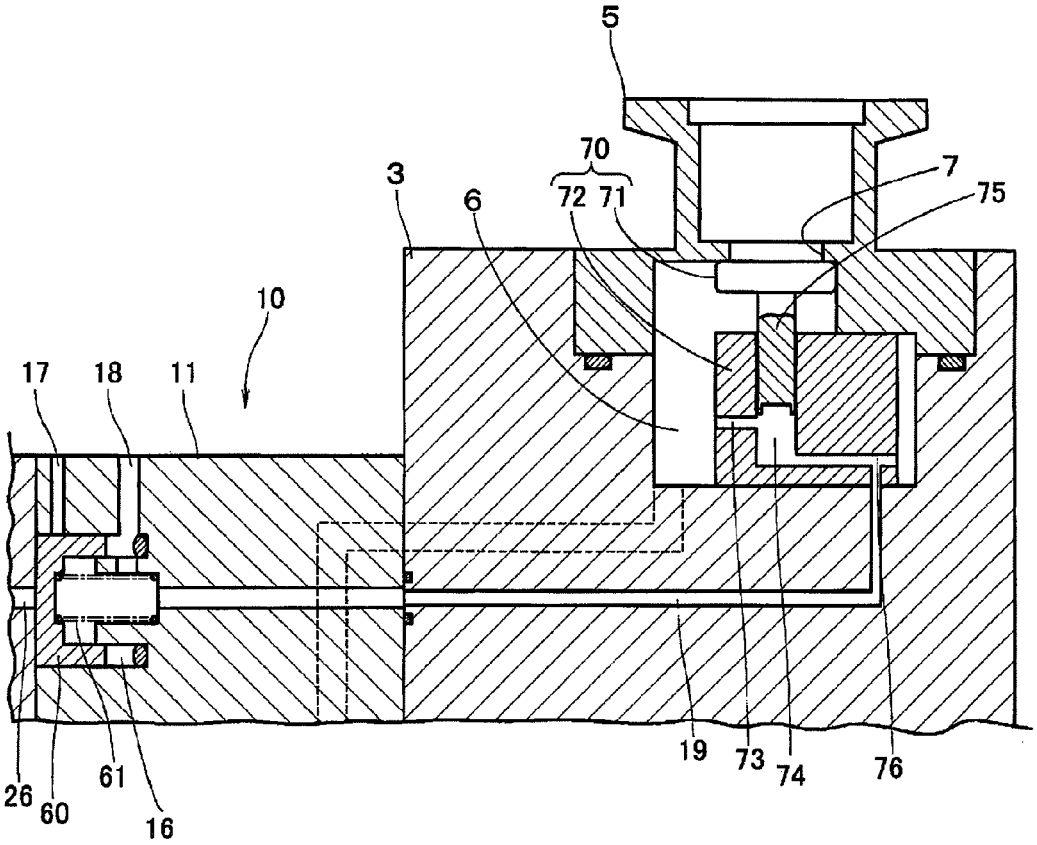
FIG. 5 is a sectional view of the essential parts illustrating the actions of the pump according to the embodiment.

When the pump 1 is not operating, on the other hand, the inlet 7 is sealed with the non-return valve 70, as shown in FIG. 5. This will be described in detail. When the first and second pumps 10 and 20 of the operating pump 1 (see FIG. 4) are stopped, the hydraulic pump 30 is also stopped in accordance with their stoppage. Because of the stoppage of the hydraulic pump 30, the lubricating oil is not pressure-fed to the introduction valve accommodation portion 16 any more, and the air introduction valve 60 is moved to the second position under the urging force of the spring 61.

Owing to the movement of the air introduction valve 60 to the second position, the air introduction path 19 communicates with the air introduction port 18, and the air introduced from the air introduction port 18 is introduced into the cylinder 74 through the air introduction path 19. At this time, the valve accommodation portion 6 is in a vacuum state, and the cylinder 74 is brought to atmospheric pressure. The valve accommodation portion 6 has a negative pressure, whereas the cylinder 74 has a positive pressure. Thus, the valve body 71 protrudes from the cylinder 74 to close the inlet 7.

When the valve body 71 protrudes from the cylinder 74, the vacuum breaking flow path 73 is rendered open. Hence, air introduced into the cylinder 74 is introduced into the valve accommodation portion 6 through the vacuum breaking flow path 73 and the communicating flow path 76. As a result, the vacuum state of the valve accommodation portion 6 is destroyed, whereby the valve accommodation portion 6 is placed under atmospheric pressure. The first pump chamber 13 and the second pump chamber 23 are also put under atmospheric pressure.

In such a state, the side upstream of the inlet 7 sealed with the valve body 71 (the side where the instrument or the like to be vacuumized is present) is maintained in a vacuum, while the valve accommodation portion 6 is at atmospheric pressure. Because of this difference in pressure, the state of the valve body 71 sealing the inlet 7 is maintained.

Even when the air introduced through the air introduction path 19 is introduced into the valve accommodation portion 6 via the communicating flow path 76, the non-return valve 70 is configured to close the inlet 7 before the entire valve accommodation portion 6 is brought to atmospheric pressure to eliminate the pressure difference from the cylinder 74. For example, the diameter of the piston portion 75 or the weight of the valve body 71 has been adjusted.

With the pump 1 according to the present embodiment, as described above, when the first pump body 10, the second pump body 20, and the hydraulic pump 30 are operated, the air introduction path 19 for introducing the air into the cylinder 74 is closed under the pressure of the lubricating oil pressure-fed by the hydraulic pump 30. By this measure, the pressure difference between the valve accommodation portion 6 (the gas flow path, including the first gas introduction path 14, between the inlet 7 and the first pump body 10) is eliminated. Thus, the non-return valve 70 does not seal the inlet 7.

The stoppage of the pump 1, namely, the stoppage of the first pump body 10, the second pump body 20 and the hydraulic pump 30, on the other hand, allows the air introduction valve 60 to open the air introduction path 19, admitting the air into the cylinder 74. As a result, a pressure difference occurs between the valve accommodation portion 6 and the cylinder 74, causing the valve body 71 to close the inlet 7. The closure of the inlet 7 by the valve body 71 blocks the vacuum vessel side, while the valve accommodation portion 6 is subjected to vacuum break.

According to the pump 1 concerned with the present embodiment described above, the non-return valve 70 for cutting off the vacuum vessel side and the first and second pump bodies 10, 20 from each other, and the air introduction valve 60 for performing its opening and closing are all provided in the pump 1, so that space saving can be achieved. Moreover, the hydraulic pump 30 is interlocked with the first pump body 10 and the second pump body 20, and the air introduction valve 60 is opened and closed in association with this hydraulic pump 30, whereby the opening and closing of the non-return valve 70 are achieved. Compared with the prior art providing a complicated and electrical control system, therefore, the pump 1 of the present embodiment makes it possible to exercise easy opening and closing control over the non-return valve 70. As described herein, the costs involved in the development and production of the apparatus (exhaust system) can be cut down by adopting the pump 1.

In the prior art, moreover, the flow path ranging from the inlet to the pump body remains maintained in a vacuum. In the pump according to the present embodiment, by contrast, when the operation of the pump body is stopped, the valve accommodation portion 6 and the first gas introduction path 14, which correspond to this flow path, are subjected to vacuum break. Thus, the lubricating oil pressed by atmospheric pressure can be prevented from contaminating the flow path and the surroundings of the shut-off valve and the inlet.

Besides, with the prior art, the shut-off valve which opens and closes the inlet is opened and closed by the lubricating oil. On the other hand, the non-return valve according to the present embodiment opens and closes in response to the pressure difference. Thus, the non-return valve according to the present embodiment can avoid a situation where its surroundings are contaminated by the leakage of the lubricating oil for opening and closing the non-return valve.

The foregoing embodiment represents a preferred example of practice of the present invention. However, the present invention is not limited thereto, but can be carried out in variously changed or modified forms without departing from the gist of the invention.

For example, the air introduction valve 60 is provided in the first casing 11. However, this is not limitative, and it may be one which can open and close the air introduction path 19 for introducing the air into the cylinder 74 of the non-return valve 70.

The non-return valve 70 is composed of the valve body 71 and the valve support 72. However, this is not limitative, and it may be one which can close the inlet in response to the pressure difference between the pressure of the valve accommodation portion 6 and the pressure of the air from the air introduction path 19. Moreover, the non-return valve 70 is provided in the flow path member 3. However, this is not limitative, and it maybe one which is disposed in the flow path between the inlet 7 and the first pump body 10 and upstream of the first pump.

Furthermore, the first pump body 10 and the second pump body 20 are illustrated as pump bodies. However, the pump bodies are not limited to them, and there may be one pump body, or two or more pump bodies.

In the present embodiment, the vane pump is taken as an example. However, this is not limitative, and the present invention can be widely applied to a pump equipped with a hydraulic pump which is interlocked with the pump body and supplies a lubricating oil to the pump body.

EXPLANATIONS OF LETTERS OR NUMERALS

V1 Shut-off valve
V2 Air introduction valve
1 Pump
6 Valve accommodation portion (flow path)
7 Inlet
9 Outlet
10 First pump body
16 Introduction valve accommodation portion
17 Lubricating oil discharge port
18 Air introduction port
19 Air introduction path
20 Second pump body
30 Hydraulic pump
36 Lubricating oil introduction path
37 Introduction valve lubricating oil flow path
45 Common shaft
55 Lubricating oil flow path
60 Air introduction valve
70 Non-return valve
71 Valve body
72 Valve support
73 Vacuum breaking flow path
74 Cylinder
75 Piston portion
76 Communicating flow path

The invention claimed is:

1. A pump, comprising:

a pump body which sucks in air from an inlet and discharges the air to an outlet;

a hydraulic pump which pressure-feeds a lubricating oil to the pump body through a lubricating oil flow path in accordance with driving of the pump body;

a non-return valve which is disposed in a flow path between the inlet and the pump body to open and close the inlet;

an air introduction path which introduces a gas having a higher pressure than a vacuum into the non-return valve; and an air introduction valve which closes the air introduction path and opens the lubricating oil flow path under action of a pressure of the lubricating oil pressure-fed by the hydraulic pump when the hydraulic pump is operating, but opens the air introduction path and closes the lubricating oil flow path when the hydraulic pump is not operating, wherein when the pump body is stopped, the non-return valve closes the inlet in response to a difference in pressure between a pressure within the flow path reduced to a value equal to or less than atmospheric pressure by operation of the pump body, and a pressure of air introduced by the opening of the air introduction valve owing to stoppage of the hydraulic pump associated with stoppage of the pump body, the pump further comprising a vacuum breaking flow path, wherein when the non-return valve closes the inlet, the air introduction valve opens to introduce the air into the non-return valve, and the vacuum breaking flow path introduces the air into the flow path, wherein the air introduction path is separated from the lubricating oil flow path by means of the air introduction valve such that the lubricating oil does not enter the air introduction path, wherein the non-return valve is equipped with a valve support where a cylinder is provided and a valve body accommodated in the cylinder for opening and closing the inlet, wherein the air introduction path is adapted to introduce the air into the cylinder, wherein when the pump body is stopped, the valve body protrudes from the cylinder and closes the inlet in response to the difference in pressure between the pressure within the flow path reduced to the value equal to or less than atmospheric pressure by the operation of the pump body, and the pressure of the air introduced into the cylinder by the opening of the air introduction valve owing to the stoppage of the hydraulic pump associated with the stoppage of the pump body, wherein the valve support is provided with a communicating flow path for bringing the cylinder and the flow path into communication, and is also provided with the vacuum breaking flow path, wherein the vacuum breaking flow path extends radially through a sidewall of the cylinder, opens into the cylinder, and communicates with the cylinder and the flow path, and wherein an opening of the vacuum breaking flow path within the cylinder is formed at such a position as to be closed by the valve body when the valve body is not sealing the inlet, but to be opened when the valve body is sealing the inlet.

* * * * *